US010800197B2

(12) United States Patent
Muraoka

(10) Patent No.: US 10,800,197 B2
(45) Date of Patent: Oct. 13, 2020

(54) PRINTING BLANKET

(71) Applicant: SHUHOU CO., LTD., Fukui (JP)

(72) Inventor: Kouji Muraoka, Fukui (JP)

(73) Assignee: SHUHOU CO., LTD., Fukui-Shi (JP)

( * ) Notice: Subject to any disclaimer, the term of this patent is extended or adjusted under 35 U.S.C. 154(b) by 0 days.

(21) Appl. No.: 15/317,275

(22) PCT Filed: May 17, 2016

(86) PCT No.: PCT/JP2016/064635
§ 371 (c)(1),
(2) Date: Dec. 8, 2016

(87) PCT Pub. No.: WO2017/199344
PCT Pub. Date: Nov. 23, 2017

(65) Prior Publication Data

US 2018/0154672 A1 Jun. 7, 2018

(51) Int. Cl.
*B41N 10/04* (2006.01)
*B41M 1/40* (2006.01)
*B41F 17/00* (2006.01)

(52) U.S. Cl.
CPC ..... *B41N 10/04* (2013.01); *B41F 17/001* (2013.01); *B41M 1/40* (2013.01); *B41N 2210/02* (2013.01);
(Continued)

(58) Field of Classification Search
CPC ..... B41N 10/04; B41F 17/34; B41F 17/001
See application file for complete search history.

(56) References Cited

U.S. PATENT DOCUMENTS 4,599,943 A 7/1986 Kohler
5,452,658 A * 9/1995 Shell ..... B41M 1/40 101/401.1
(Continued)

FOREIGN PATENT DOCUMENTS

CN 102781679 A 11/2012
CN 102811865 A 12/2012
(Continued)

OTHER PUBLICATIONS

FAQ Urethane Rubbers, (https://us.misumi-ec.com/maker/misumi/mech/product/ur/faq/), retrieved on Jul. 6, 2018.*
(Continued)

*Primary Examiner* — Jennifer E Simmons
*Assistant Examiner* — Quang X Nguyen
(74) *Attorney, Agent, or Firm* — Ladas & Parry LLP

(57) ABSTRACT

Provided is a printing blanket that is unlikely to cause portions uncoated with ink even when the printing-applied surface has protrusions. The printing blanket according to an embodiment of the present invention includes a printing surface to be pressed against a printing plate on which the ink is placed and against the surface on which printing is applied and that is a target of printing. The printing blanket further includes a substrate, an inner coating layer covering at least part of the surface of the substrate, and an outer coating layer covering at least part of the surface of the inner coating layer that is on the side opposite the substrate. The inner coating layer has a smaller Asker C hardness than the substrate, and the outer coating layer has the printing surface on the side opposite the inner coating layer.

9 Claims, 5 Drawing Sheets

(52) U.S. Cl.
CPC ..... *B41N 2210/04* (2013.01); *B41N 2210/14* (2013.01)

(56) References Cited

U.S. PATENT DOCUMENTS

| | | | | |
|---|---|---|---|---|
| 7,870,823 | B1 * | 1/2011 | Cameron | B41F 17/006 101/163 |
| 2008/0202370 | A1 | 8/2008 | Muraoka | |
| 2012/0318154 | A1 * | 12/2012 | Muraoka | B41N 10/02 101/401.1 |
| 2013/0008330 | A1 * | 1/2013 | Yoo | B41N 10/04 101/401.1 |

FOREIGN PATENT DOCUMENTS

| | | | |
|---|---|---|---|
| EP | 2 543 519 | A1 | 1/2013 |
| JP | 58-167197 | A | 10/1983 |
| JP | 60-161151 | A | 8/1985 |
| JP | 62-132691 | A | 6/1987 |
| JP | 9-58108 | A | 3/1997 |
| JP | 2000-25178 | A | 9/2000 |
| JP | 2000-238458 | A | 9/2000 |
| JP | 2003-321554 | A | 11/2003 |
| JP | 2005-349800 | A | 12/2005 |
| JP | 2006-159822 | A | 6/2006 |
| JP | 2009-61662 | A | 3/2009 |
| JP | 2010-274542 | A | 12/2010 |
| JP | 2011-736 | A | 1/2011 |
| JP | 2013-522084 | A | 6/2013 |
| JP | 2015-171779 | A | 10/2015 |
| KR | 10-2007-0039121 | A | 4/2007 |
| TW | 201511975 | A | 4/2015 |
| TW | 201536568 | A | 10/2015 |
| WO | 97/34768 | A1 | 9/1997 |
| WO | 02/45961 | A1 | 6/2002 |

OTHER PUBLICATIONS

Taiwanese Office Action dated Jun. 15, 2017 for Taiwanese Application No. 105139650 with English translation.
Espacenet English abstract of TW 201511975 A.
Espacenet English abstract of TW 201536568 A.
Espacenet English abstract of CN 102781679 A.
Korean Office Action dated Jul. 26, 2017 for Koran Application No. 10-2016-7034382 with English translation.
English translation of JP 2000-238458 A.
English translation of JP 2015-171779 A.
International Search Report (ISR) and Written Opinion (WO) dated Aug. 2, 2016 for International Application No. PCT/JP2016/064635.
J-PlatPat English abstract of JP 2011-736 A.
J-PlatPat English abstract of JP 9-58108 A.
J-PlatPat English abstract of JP 2009-61662 A.
J-PlatPat English abstract of JP 2005-349800 A.
J-PlatPat English abstract of JP 62-132691 A.
English translation of JP 2013-522084 A.
Taiwanese Office Action dated Dec. 22, 2017 for Taiwan Application No. 105139650 with English translation.
Chinese Office Action with an English translation dated Feb. 3, 2019 for Application No. CN 2016800001802.1.
Japanese Office Action with an English translation dated Jul. 9, 2019 for Application No. JP 2018-1517976.1.
Supplementary European Search Report (SESR) dated Nov. 29, 2019 mailed in connection with European Patent Application No. EP 16801687.1.
Japanese Office Action (Notice of Reasons for Refusal) with an English translation dated Jan. 21, 2020 mailed in connection with JP Application No. JP 2018-517976.
English abstract of WO 97/34768 A1.
Patent Abstracts of Japan English abstract of JP 2006-159822 A.
Patent Abstracts of Japan English abstract of JP 2000-25178 A.
Office Action in Chinese Patent Application No. 201680001802.1 dated Sep. 16, 2019, with English translation.
Chinese Office Action with an English translation dated Feb. 3, 2020 in connection with corresponding Chinese Patent Application No. 201680001802.1.

* cited by examiner

PRINTING BLANKET

RELATED APPLICATION

This application is an application under 35 U.S.C. 371 of International Application No. PCT/JP2016/064635 filed on May 17, 2016, the entire contents of which are incorporated herein by reference.

TECHNICAL FIELD

The present invention relates to a printing blanket usable for blanket printing in which an ink transferred from a printing plate is transferred to a printing-applied surface, a surface on which printing is applied.

BACKGROUND ART

In blanket printing, a printing surface of the printing blanket is typically pressed against a printing plate to transfer an ink placed on the printing plate according to a printing pattern to the printing blanket. Then, the printing surface of the printing blanket to which the ink has been transferred is pressed against a printing-applied surface, the surface on which printing is applied to transfer the transferred ink to the printing-applied surface, and the printing pattern is thereby printed on the printing-applied surface.

In the technique of the related art, the printing blanket is an elastic body such as elastic (flexible) silicone rubber with silicone oil mixed therein and is formed into a substantially hemispherical shape, a bullet shape, or a substantially semi-cylindrical shape having a bullet-shaped cross section. The printing surface of the elastic body is pressed against the flat printing plate to transfer the ink from the printing plate to the printing surface. Then, the printing surface is pressed against the curved or irregular printing-applied surface to transfer the ink from the printing surface to the printing-applied surface.

For example, in Patent Literature 1, an ink is placed on small printing plates corresponding to small to-be-printed surfaces so as to extend along small developed pictures corresponding to the small to-be-printed surfaces. Then small printing blankets corresponding to the small to-be-printed surfaces are pressed against their corresponding small printing plates to transfer the ink to the small printing blankets. Then, the small printing blankets are pressed against their corresponding small to-be-printed surfaces to transfer small pictures to print the small pictures thereon. Specifically, these small printing blankets are pressed against their corresponding small printing plates to transfer the ink to the small printing blankets. Then these small printing blankets are pressed against their corresponding small to-be-printed surfaces to print the small pictures on the small to-be-printed surfaces. This allows printing on a printing medium having a complicated shape.

CITATION LIST

Patent Literature

Patent Literature 1: Japanese Unexamined Patent Application Publication No. 2011-736

SUMMARY OF INVENTION

Technical Problem

However, the printing disclosed in Patent Literature 1 has the following problems. Since the printing is performed by pressing the small printing blankets against the printing medium having a complicated shape, ink overlapping may occur at the boundaries between adjacent small to-be-printed surfaces, or blank spaces may be left at the boundaries. This affects the quality of the printed image. Moreover, a plurality of small printing blankets are necessary to print on one printing medium. Therefore, the printing process takes a long time, and the plurality of small printing blankets need to be cleaned and repaired. This results in an increase in cost of printing.

The present invention has been made to solve the foregoing problems and provides a printing blanket that allows printing on a printing medium having a complicated shape and can reduce the cost of printing.

Solution to Problem

A printing blanket according to an embodiment of the present invention includes: a printing surface that is located on a surface of the printing blanket and is to be pressed against a printing plate on which an ink is placed and against a printing-applied surface that is a target of printing; an inner layer to which a pressing force is applied when the printing surface is pressed against the printing plate or the printing-applied surface; and an outer layer disposed, on a side on which the printing surface is disposed, in contact with the inner layer, the outer layer having a lower Asker C hardness than the inner layer.

Advantageous Effects of Invention

In the above embodiment of the present invention, the outer layer is more easily deformable than the inner layer, so that the printing surface of the printing blanket can easily follow the printing-applied surface even when it has a complicated shape. Therefore, even when the printing-applied surface has a complicated shape, the entire printing-applied surface can be printed using only one printing blanket. This can ensure the quality of the printed image and reduce the cost of printing.

DESCRIPTION OF EMBODIMENTS

Embodiment 1

Figure 1:
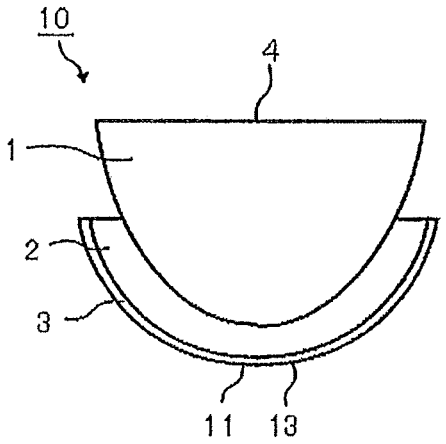
FIG. 1 is a cross-sectional view of a printing blanket according to Embodiment 1 of the present invention.

A printing blanket according to Embodiment 1 of the present invention will be described with reference to the drawings. However, the present invention is not limited to Embodiments described below. Throughout the drawings, the same parts are denoted by the same symbols, and their description will be partially omitted. The drawings are schematic illustrations, and the present invention is not limited to the shapes shown in the drawings (in particular, the thickness of sheets is exaggerated). In the present description, the elastic body or elasticity is not limited to those in which a load applied to the elastic body has a linear relation with the amount of deformation due to the load and is intended to encompass those in which the load has a nonlinear relation with the amount of deformation and which return to their original shape immediately or a predetermined time after the applied load is removed.

<Printing Blanket 10>

Figure 2:
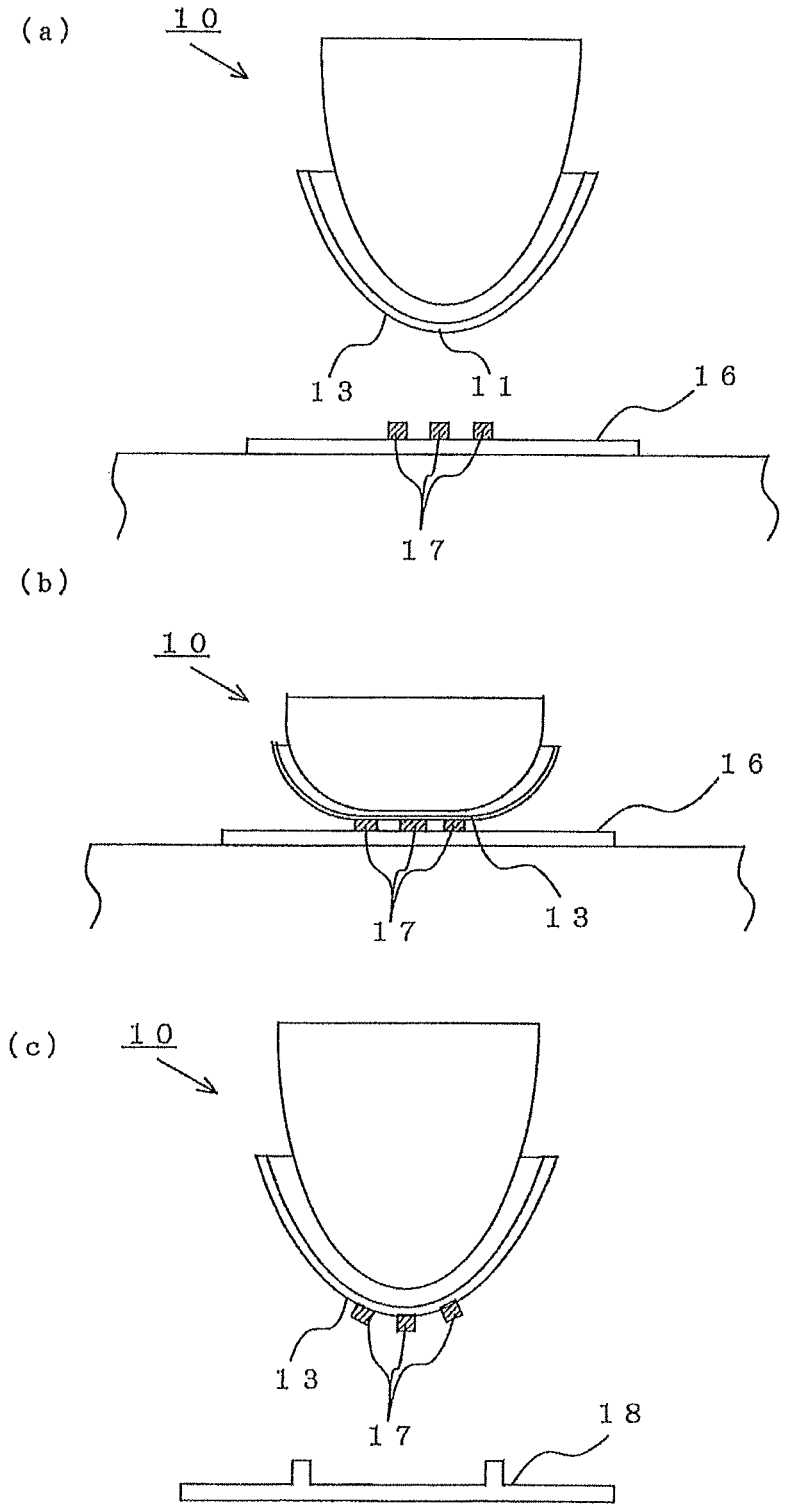
FIG. 2 includes illustrations of printing using the printing blanket according to Embodiment 1 of the present invention.

FIG. 1 is a cross-sectional view of a printing blanket 10 according to Embodiment 1 of the present invention. FIG. 2 includes illustrations of printing using the printing blanket 10 according to Embodiment 1 of the present invention. The printing blanket 10 shown in FIG. 1 includes a substantially hemispherical elastic body. As shown in FIG. 2, the printing blanket 10 is pressed against a printing plate 16 on which an ink 17 is placed to thereby transfer the ink 17 to a printing surface 13 on the surface of the elastic body. Then, this printing surface 13 is pressed against a printing-applied surface 18, on which printing is applied and which is a target of printing, to thereby transfer the ink 17 to the printing-applied surface. The printing is performed in the manner described above.

The printing blanket 10 has a bottom surface 4 that is a flat portion of the substantially hemispherical shape, and the distance between the center of the bottom surface 4 to an apex 11 is longer than that of an ordinarily hemisphere having a bottom surface with the same area as the bottom surface 4. Specifically, the printing blanket 10 has a bullet-like shape. The shape of the printing blanket 10 is not limited to the bullet-like shape and may be appropriately changed according to, for example, the relief of the printing-applied surface 18. Examples include a hemispherical shape, a curved surface produced by rotating a parabola about its symmetry axis, a shape obtained by partially cutting an ellipsoid, a bullet shape, and a shape obtained by continuously arranging semicircular shapes on a straight line. On the surface of the printing blanket 10 in Embodiment 1, a predetermined region extending with the apex 11 as the center serves as the printing surface 13 to which the ink 17 is transferred from the printing plate 16 and from which the ink 17 is transferred to the printing-applied surface 18.

FIG. 1 shows a cross section passing through the apex 11 of the printing blanket 10 and perpendicular to the bottom surface 4. As shown in FIG. 1, the printing blanket 10 includes an inner layer 1, an outer layer 2 bonded to the inner layer 1 so as to follow its curved surface, and a protective coating layer 3 bonded to the outer surface of the outer layer 2. The printing blanket 10 is not limited to having the three-layer structure shown in FIG. 1 and may include a larger number of layers. The printing blanket 10 may not include the protective coating layer 3 and may have a two-layer structure including the inner layer 1 and the outer layer 2.

<Inner Layer 1>

The inner layer 1 is formed by molding, for example, silicone rubber. Silicone oil is mixed into the inner layer 1 to impart elasticity (flexibility) to the inner layer 1 to thereby allow the inner layer 1 to be easily deformable. In Embodiment 1, the inner layer 1 has a bullet shape, as does the printing blanket 10. However, the shape of the inner layer 1 may be appropriately changed according to the relief of the printing-applied surface 18. The inner layer 1 deforms when pressed against the printing plate 16 shown in FIG. 2, so that the printing surface 13 comes into contact with the printing plate 16. No limitation is imposed on the material of the inner layer 1, so long as the deformation of the inner layer 1 allows the ink 17, applied to the printing plate 16, corresponding to a printing pattern to be transferred to the printing surface 13 and also allows the transferred ink to be transferred to the printing-applied surface 18 when the printing surface 13 is pressed against the printing-applied surface 18 shown in FIG. 2.

<Outer Layer 2>

The outer layer 2 is formed from silicone rubber in sheet form with a predetermined thickness (e.g., 5 mm). The outer layer 2 is bonded to at least part of the surface of the inner layer 1 and located on the inner side of the printing surface 13 of the printing blanket 10. The outer layer 2 is configured to, when the printing blanket 10 is pressed against the printing plate 16 or the printing-applied surface 18, deform so that the printing surface 13 follows the printing plate 16 or the printing-applied surface 18 and comes into intimate contact therewith.

In Embodiment 1, the silicone rubber forming the outer layer 2 has a lower hardness than the silicone rubber forming the inner layer 1 and the silicone rubber forming the protective coating layer 3. For example, when the Asker C hardness of the material of the inner layer 1 is 100 points, the hardness of the outer layer 2 is set such that its Asker C hardness is within the range of 50 to 70 points. The Asker C hardness of the material of the inner layer 1 and the Asker C hardness of the material of the protective coating layer 3 are not limited to 100 points and may be appropriately selected. For example, when the Asker C hardness of the inner layer 1 is set to 80 points, the Asker C hardness of the material forming the outer layer 2 is set within the range of 40 to 56 points.

In Embodiment 1, the outer layer 2 is formed from a sheet-shaped material thicker than the protective coating layer 3. The thickness of the outer layer 2 may be appropriately set according to the shape of the printing-applied surface 18, particularly to the height of irregularities formed on the printing-applied surface 18. Desirably, the thickness of the outer layer 2 is at least twice the height of the irregularities formed on the printing-applied surface 18.

The material of the outer layer 2 is not limited to silicone rubber, and any material may be used so long as it deforms when pressed against the printing plate 16 to thereby allow the printing surface 13 to be pressed against the printing plate 16 and so long as, when the material is pressed against the printing-applied surface 18, the printing surface 13 is allowed to follow the shape of the printing-applied surface 18 and come into intimate contact with the printing-applied surface 18. Desirably, the material of the outer layer 2 is elastic enough to allow the outer layer 2 to follow the surface of the inner layer 1 and to be bonded thereto in the step of bonding the outer layer 2 to the inner layer 1.

The material of the outer layer 2 is not limited to the sheet-shaped material, and the outer layer 2 may be, for example, a molded product molded using a die. Also in this case, the outer layer 2, particularly its portion corresponding to the printing surface 13, is formed thicker than the protective coating layer 3. The outer layer 2 may have a uniform thickness over its entire area as shown in FIG. 1 or may have, for example, a non-uniform shape with a thin portion.

The outer layer 2 may include a plurality of layers. In this configuration, when a sheet-shaped material is used for the outer layer 2, the thickness of the outer layer 2 can be easily changed by bonding plies of the sheet-shaped material to the surface of the inner layer 1. Even for different surfaces to be printed 18 having irregularities with different heights, it is unnecessary to prepare many sheet materials with different thicknesses, and the thickness of the outer layer 2 can be adjusted by changing the number of plies of one sheet material. The inner layer 1 of the printing blanket 10 can be repeatedly used. Specifically, the outer layer 2 and the protective coating layer 3 are removed from the inner layer 1, and then a new outer layer 2 and a new protective coating layer 3 are bonded to the inner layer 1. This can reduce the cost of the printing blanket 10. The outer layer 2 is bonded to the inner layer 1 using, for example, an adhesive.

<Protective Coating Layer 3>

The protective coating layer 3 forms the outer surface of the printing blanket 10 and is formed, for example, by bonding a 0.5 mm silicone rubber sheet to the surface of the outer layer 2. The protective coating layer 3 is provided to prevent the silicone oil contained in the soft inner silicone rubber from exuding to the printing surface 13. The outer surface of the protective coating layer 3 that forms the printing surface 13 is required to have scratch and wear resistance because the outer surface is repeatedly pressed against the printing plate 16 and the printing-applied surface 18. Therefore, the material used for the protective coating layer 3 has a higher hardness than the material used for the outer layer 2, and the protective coating layer 3 is thin enough to allow the printing surface 13 to follow the printing-applied surface 18 when pressed against the printing-applied surface 18. In Embodiment 1, the thickness of the printing surface 13 is as small as possible and is preferably within the range of, for example, 0.1 mm to 1 mm. The material of the protective coating layer 3 is not limited only to silicone rubber, and any material may be appropriately selected so long as it can follow the deformation of the inner layer 1. Desirably, the material of the protective coating layer 3 is elastic enough to allow the protective coating layer 3 to be bonded along the surface of the inner layer 1 in the step of bonding the protective coating layer 3 to the inner layer 1.

The printing blanket 10 may be configured with the protective coating layer 3 omitted. In this case, the printing blanket 10 is disadvantageous in that, since the soft outer layer 2 is uncoated, the strength and durability of this printing blanket 10 are lower than those of the printing blanket 10 with the protective coating layer 3 and that the degree of exudation of the silicone oil increases. However, the printing blanket 10 with no protective coating layer 3 can be used for printing in the same manner as the printing blanket 10 with the protective coating layer 3.

<Printing Using Printing Blanket 10>

In Embodiment 1, printing using the bullet-shaped printing blanket 10 will be described as an example.

In Embodiment 1, the ink 17 is placed on the printing plate 16, as shown in FIG. 2(*a*). The ink 17 is placed on a plurality of regions so as to form a predetermined printing image. The ink 17 is placed on the printing plate 16 by intaglio, letterpress, or inkjet printing.

As shown in FIG. 2(*b*), the apex 11 of the printing blanket 10 is pressed against the printing plate 16, and the printing blanket 10 thereby deforms, so that a predetermined region extending with the apex 11 as the center is pressed against the surface of the printing plate 16. The predetermined region is referred to as the printing surface 13. The ink 17 on the printing plate 16 adheres to the printing surface 13 of the printing blanket 10 and is transferred to the printing surface 13. The outer layer 2 is formed of silicone rubber containing a large amount of silicone oil and therefore easily deforms. The protective coating layer 3 bonded to the surface of the inner layer 1 is formed of, for example, silicone rubber having a higher hardness than the outer layer 2. However, the protective coating layer 3 has a thin sheet shape and can therefore follow the deformation of the outer layer 2.

Before the printing blanket 10 is pressed against the printing plate 16, a solvent may be applied to the printing surface 13 to wet the printing surface 13. This treatment allows the ink 17 to be easily transferred to the printing surface 13.

As shown in FIG. 2(*c*), after the ink 17 is transferred to the printing surface 13, the printing surface 13 is pressed against the printing-applied surface 18. Then, the ink 17 transferred to the printing surface 13 is transferred from the printing surface 13 to the printing-applied surface 18, and the printing image is thereby transferred. The printing blanket 10 is configured to be easily deformable and can therefore easily follow and conform to a curved printing-applied surface. In Embodiment 1, the silicone rubber forming the protective coating layer 3 has a higher hardness than the silicone rubber forming the outer layer 2, and the amount of silicone oil mixed into the protective coating layer 3 is smaller than that into the outer layer 2. Therefore, when the printing blanket 10 deforms, the silicone oil mixed into the outer layer 2 is substantially sealed by the protective coating layer 3 surrounding the outer layer 2. Since the amount of the silicone oil mixed into the protective coating layer 3 is small, the silicon oil is unlikely to exude to the printing surface 13 formed by the protective coating layer 3. Therefore, an appropriate amount of the silicone oil adheres to the printing surface 13. When the printing surface 13 in this state is pressed against the printing-applied surface 18, the ink 17 is unlikely to remain on the printing surface 13 and is easily transferred to the printing-applied surface 18.

<State of Printing Surface 13 During Printing>

Figure 3:
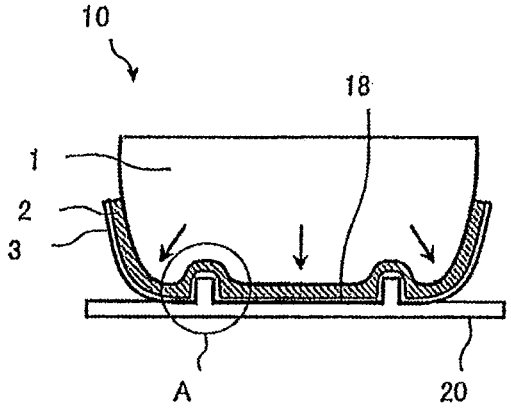
FIG. 3 is a cross-sectional view of the printing blanket according to Embodiment 1 of the present invention, the printing blanket being pressed against a printing-applied surface.
Figure 4:
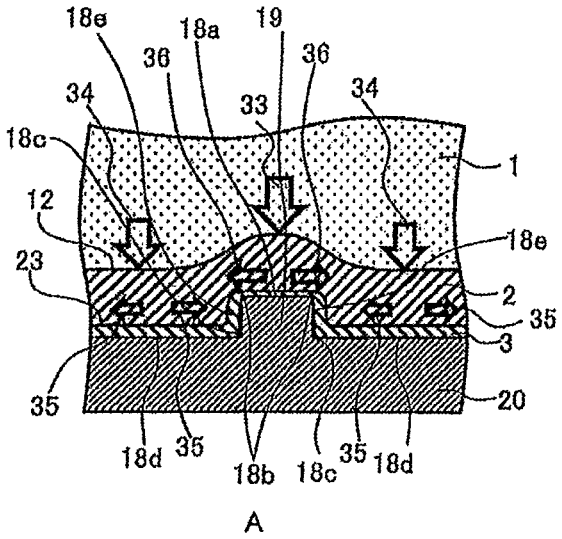
FIG. 4 is an enlarged view of portion A in FIG. 3.
Figure 5:
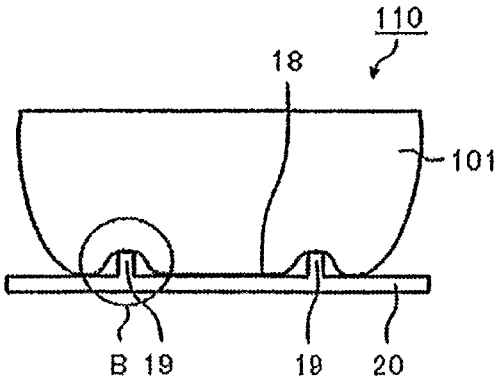
FIG. 5 Related Art
FIG. 5 is a cross-sectional view of a printing blanket in a comparative example with no outer layer 2 and no protective coating layer 3, the printing blanket being pressed against the printing-applied surface.
Figure 6:
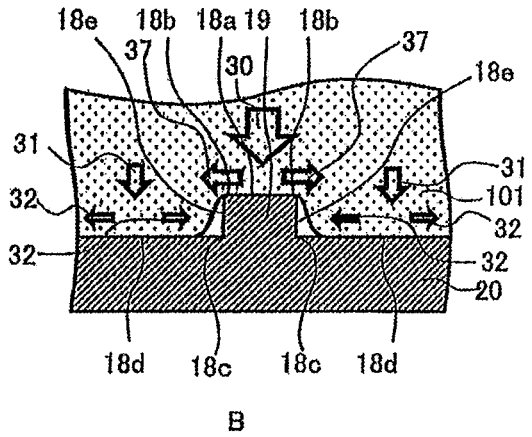
FIG. 6 Related Art
FIG. 6 is an enlarged view of portion B in FIG. 5.

FIG. 3 is a cross-sectional view of the printing blanket 10 according to Embodiment 1 of the present invention, the printing blanket 10 being pressed against the printing-applied surface 18. FIG. 4 is an enlarged view of portion A in FIG. 3. FIG. 5 is a cross-sectional view of a printing blanket 110 in a comparative example with no outer layer 2 and no protective coating layer 3, the printing blanket 110 being pressed against the printing-applied surface 18. FIG. 6 is an enlarged view of portion B in FIG. 5.

The printing-applied surface 18 of a printing object 20 has surface irregularities. In Embodiment 1, two protrusions 19 having a rectangular cross section are disposed. However, the cross-sectional shape is not limited thereto. The cross-sectional shape may be, for example, a semi-circular shape or a triangular shape, or the printing-applied surface 18 as a whole may be undulated into a wavy shape. As shown in FIG. 3 and FIG. 4, the printing surface 13 is in intimate contact with an upper surface 18*a*, corners 18*b*, side surfaces 18*e*, and edges 18*c* of each of the protrusions 19 and with the entire flat portion 18*d* of the printing-applied surface 18.

Therefore, the ink 17 adhering to the printing surface 13 is transferred to the entire printing-applied surface 18 including the protrusions 19.

In the technique of the related art, printing is performed using the printing blanket 110 including only an inner layer 101 as shown in FIGS. 5 and 6. Therefore, the printing surface 13 of the printing blanket 110 is not in intimate contact with the peripheries of the protrusions 19 on the printing-applied surface 18, and gaps are likely to be formed. Particularly, as shown in FIG. 6, the printing surface 13 is unlikely to come into intimate contact with the side surfaces 18*e* and edges 18*c* of each of the protrusions 19. The printing blanket 10 is pressed against the printing-applied surface 18 from substantially vertically above to apply a pressing force (arrows 30 and 31 in FIG. 6). The pressing force is applied to the inner layer 101 of the printing blanket 10 from, for example, a printing device (not shown) to which the printing blanket 10 is attached. When the inner layer 101 is pressed against the printing-applied surface 18 and deforms in the vertical direction in FIG. 6, the inner layer 101 deforms also in a direction substantially parallel to the printing-applied surface 18, and a force acts in a direction perpendicular to the direction of the pressing force applied to the printing blanket 10 (a direction of arrows 31 and 37 in FIG. 6). Since the inner layer 101 is formed from a single material, the hardness of the inner layer 101 is uniform over its entire area, so that the force is concentrated only on a largely deformed portion shown by the arrow 30 in FIG. 6 and is less likely to act on other portions. Therefore, in the less deformed portions of the inner layer 101, the force generated by the deformation in the direction substantially parallel to the printing-applied surface 18 (the force acting in the direction of the arrows 31 in FIG. 6) is also small. Specifically, the pressing force that causes the printing surface 13 to be pressed against the side surfaces 18*e* and the edges 18*c* is small. Therefore, as shown in FIG. 6, gaps are formed between the printing surface 13 and the side surfaces 18*e* and the edges 18*c*, and the ink 17 is less likely to be transferred thereto. The sizes of the arrows 30, 31, 32, and 37 shown in FIG. 6 schematically represent the magnitudes of the forces.

However, the printing blanket 10 according to Embodiment 1 includes the inner layer 1 formed of a relatively hard material and the outer layer 2 formed of a soft material, and these layers are bonded together at an interface 12. Therefore, as shown in FIG. 4, the deformation of the outer layer 2 is large around the protrusions 19, but the deformation of the inner layer 1 is small around the protrusions 19. In this case, the pressing force causing the printing blanket 10 to be pressed against the printing-applied surface 18 is transmitted evenly over the entire outer layer 2 through the inner layer 1 as shown by arrows 33 and 34 in FIG. 4. Specifically, in the outer layer 2, the force acts more evenly over the entire printing surface 13 as compared to that in the technique of the related art. Therefore, when the printing blanket 10 is pressed against the printing-applied surface 18 in a direction substantially perpendicular thereto and thereby deforms, the printing blanket 10 deforms also in a direction substantially parallel to the printing-applied surface 18. In this case, the force generated by the deformation in the direction substantially parallel to the printing-applied surface 18 (the force acting in the direction of arrows 35 and 36 in FIG. 4) also acts evenly. Therefore, in the printing blanket 10 according to Embodiment 1, the pressing force causing the printing surface 13 to be pressed against the side surfaces 18*e* and the edges 18*c* is larger than that in the technique of the related art shown in FIG. 6.

To ensure the durability of the printing blanket 10 and to suppress the exudation of the silicone oil present inside the printing blanket 10, the protective coating layer 3 having the printing surface 13 is bonded to the outer surface of the outer layer 2. Although the protective coating layer 3 is formed of a material having a higher hardness than the outer layer 2, the protective coating layer 3 is thin and can therefore easily follow the deformation of the outer layer 2. Specifically, the protective coating layer 3 is configured such that its influence is small when printing is performed on the printing-applied surface 18 having the protrusions 19 as shown in FIG. 4.

Embodiment 2

In a printing blanket 210 according to Embodiment 2 of the present invention, changes are made to the configuration of the inner layer 1 and the outer layer 2 in the printing blanket 10 according to Embodiment 1. As for the printing blanket 210 according to Embodiment 2, the changes to Embodiment 1 will be mainly described. In the printing blanket 210 according to Embodiment 2, its components having the same functions as those in the drawings used for the description of Embodiment 1 are denoted by the same symbols.

<Configuration of Printing Blanket 210>

Figure 7:
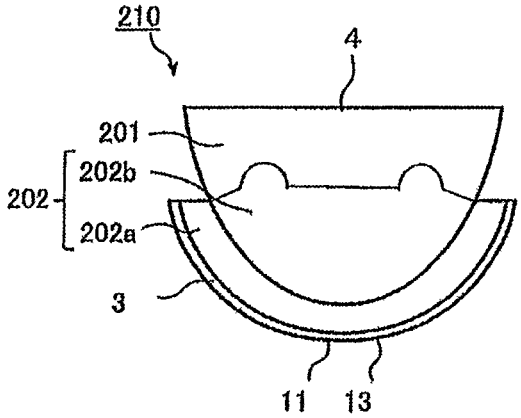
FIG. 7 is a cross-sectional view of a printing blanket according to Embodiment 2 of the present invention.
Figure 8:
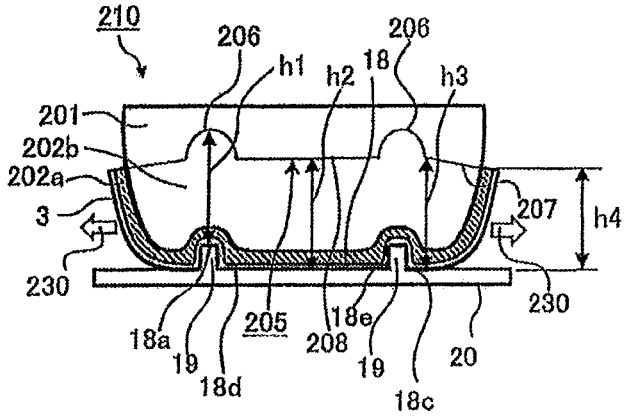
FIG. 8 is a cross-sectional view of the printing blanket according to Embodiment 2 of the present invention, the printing blanket being pressed against the printing-applied surface.

FIG. 7 is a cross-sectional view of the printing blanket 210 according to Embodiment 2 of the present invention. FIG. 8 is a cross-sectional view of the printing blanket 210 according to Embodiment 2 of the present invention, the printing blanket 210 being pressed against the printing-applied surface 18.

As shown in FIG. 7, only an upper part of the inner layer 1 according to Embodiment 1 is used as an inner layer 201 of the printing blanket 210, and the inner layer 201 is formed by molding, for example, an ABS resin. Specifically, the inner layer 201 is formed from a material having higher stiffness than the inner layer 1 in Embodiment 1. The material of the inner layer 201 is not limited to the ABS resin, and any other material such as a resin or a metal may be used, so long as its deformation when a force is applied during printing is very small.

An outer layer 202*b* is disposed in contact with the inner layer 201 of the printing blanket 210 on the side of the inner layer 201 toward the printing surface. The outer layer 202*b* is formed by molding, for example, silicone rubber. Silicone oil is mixed into the outer layer 202*b* to impart elasticity (flexibility) to the outer layer 202*b* to thereby allow the outer layer 202*b* to be easily deformable. An outer layer 202*a* is bonded to the surface of the outer layer 202*b* formed into, for example, a bullet shape. Elasticity is imparted to the outer layer 202*a* as well as the outer layer 202*b*. The hardness of the outer layer 202*a* may be the same as or different from the hardness of the outer layer 202*b*. For example, in Embodiment 2, the outer layer 202*b* is formed of the same material as the material of the inner layer 1 in Embodiment 1, and the outer layer 202*a* is formed of the same material as the material of the outer layer 2 in Embodiment 1. The printing blanket 210 is configured such that when the printing blanket 210 is pressed against, for example, the printing-applied surface 18, the outer layer 202*a* and the outer layer 202*b* easily deform but the deformation of the inner layer 201 is very small.

As in the case of the printing blanket 210 in Embodiment 1, the protective coating layer 3 is bonded to the surface of the outer layer 202*a* that is on the side toward the printing surface 13, that is, the outer surface of the outer layer 202*a*.

Also in Embodiment 2, the printing blanket 210 may be configured with the protective coating layer 3 omitted.

<Molded Surface 205>

The inner layer 201 has a mold surface 205 on its side in contact with the outer layer 202*b* located on the side toward the printing surface 13. The mold surface 205 has a shape resembling a shape obtained by transferring the irregularities such as the protrusions 19 disposed on the printing-applied surface 18. For example, in Embodiment 2, recessed portions 206 are disposed on the mold surface 205 above the printing surface 13 to be in contact with the protrusions 19 on the printing-applied surface 18. Therefore, when the printing surface 13 is pressed against the printing-applied surface 18 during printing, the distance h1 from an upper surface 18*a* of each of the protrusions 19 disposed on the printing-applied surface 18 to the mold surface 205 directly above the upper surface 18*a* is substantially the same as the distance h2 from the flat portion 18*d* to the mold surface 205 directly above the flat portion 18*d*. Specifically, when the printing surface 13 is not pressed against the printing-applied surface 18, the thickness of the silicone rubber in its portions above portions of the printing surface 13 that are to be in contact with the protrusions 19 is larger than the thickness of other portions.

For example, when the mold surface 205 does not have the recessed portions 206, the thickness of the silicone rubber in its portions above the portions of the printing surface 13 that are to be in contact with the protrusions 19 is smaller than the thickness of other portions. In this case, when the protrusions 19 are in contact with the printing surface 13, the pressing force of the printing surface 13 acting on the protrusions 19 becomes large. However, in Embodiment 2, the mold surface 205 has the recessed portions 206. In this case, when the printing blanket 210 is pressed against the printing-applied surface 18, the force transmitted from the printing surface 13 to the protrusions 19 is smaller than that when the mold surface 205 has no recessed portions 206. This is because the thickness of the silicone rubber in its portions above the portions of the printing surface 13 that are in contact with the protrusions 19 is large as shown in FIG. 8. Therefore, the pressing force of the printing blanket 210 acting on the printing-applied surface 18 is evenly distributed over the entire printing-applied surface 18. Similarly, since the force is applied evenly from the inner layer 201 to the outer layer 2 formed of a soft material, the pressing force causing the printing surface 13 to be pressed against the side surfaces 18*e* and edges 18*c* of the protrusions 19 tends to be larger than that in Embodiment 1.

An outer circumferential portion of the mold surface 205 that extends toward its outer circumference may be inclined toward the printing surface 13. In other words, the outer circumferential portion of the mold surface 205 may be configured such that, when the printing surface 13 is pressed against the printing-applied surface 18 during printing, the distance between the outer circumferential portion and the printing-applied surface 18 decreases as the distance to the outer circumference decreases. A portion of the mold surface 205 that is located on the outer circumference side of the inner layer 201 is referred to as an outer circumferential mold surface 207. A portion of the mold surface 205 that is located on the inner side of the inner layer 201 is referred to as an inner mold surface 208. The relation between the distances h3 and h4 between the outer circumferential mold surface 207 and the printing-applied surface 18 when the printing surface 13 is pressed against the printing-applied surface 18 during printing is set such that the distance h3 at an inner position is larger than the distance h4 at an outer circumferential position.

The outer circumferential mold surface 207 is configured as described above. In this case, as shown in FIG. 8, when the outer layer 202*b* is pressed against the printing-applied surface 18, the outward deformation of the outer layer 202*b* is suppressed, so that the force can be transmitted substantially evenly over the entire outer layer 202*a*. Specifically, when the outer layer 202*b* is pressed against the printing-applied surface 18, the outer layer 202*b* deforms so as to expand in the direction of arrows 230 in FIG. 8. However, since the outer circumferential mold surface 207 is formed such that this deformation is suppressed, the pressing force of the printing blanket 210 acting on the printing-applied surface 18 is unlikely to be dispersed. Similarly, the force is applied substantially evenly from outer layer 202*b* to the outer layer 202*a* formed of a soft material, and therefore the pressing force causing the printing surface 13 to be pressed against the side surfaces 18*e* and edges 18*c* of the protrusions 19 tends to be larger than that in Embodiment 1.

In FIG. 8, a cross section of the outer circumferential mold surface 207 is denoted by a straight line. However, the outer circumferential mold surface 207 may be a curved surface having a curved cross section such as an arc-shaped cross section. Also a cross section of the inner mold surface 208 is denoted by a straight line. However, the inner mold surface 208 may be formed so as to approach the printing-applied surface 18 as the distance from the center of the inner layer 201 toward its outer circumference increases.

Figure 9:
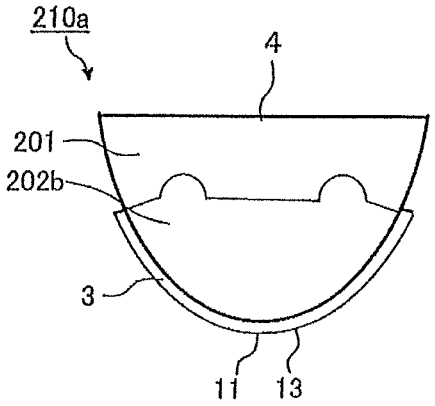
FIG. 9 is a cross-sectional view showing a modification of the printing blanket in Embodiment 2 of the present invention.
Figure 10:
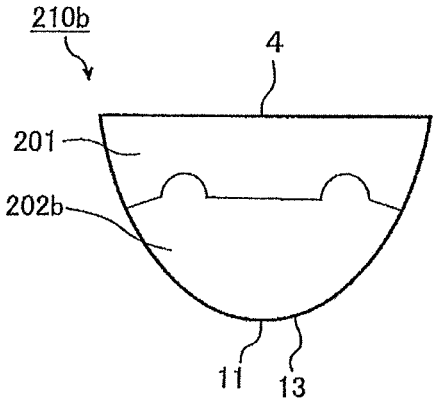
FIG. 10 a cross-sectional view showing another modification of the printing blanket in Embodiment 2 of the present invention.

FIGS. 9 and 10 are cross-sectional views showing modifications of the printing blanket 210 in Embodiment 2.

A printing blanket 210*a* shown in FIG. 9 does not include the outer layer 202*a* of the printing blanket 210. A printing blanket 210*b* shown in FIG. 10 has a configuration in which the protective coating layer 3 of the printing blanket 210*a* is further omitted. Even with these configurations, printing equivalent to that using the printing blanket 210 can be performed by appropriately changing the hardness of the outer layer 202*b* and appropriately changing its dimensions such as thickness.

<Effects of Embodiments>

(1) The printing blanket 10, 210, 210*a*, 210*b* in Embodiment 1 or 2 includes: the printing surface 13 that is located on a surface of the printing blanket and is to be pressed against the printing plate 16 on which the ink 17 is placed and against the printing-applied surface 18 that is a target of printing; the inner layer 1, 201 to which a pressing force is applied when the printing surface 13 is pressed against the printing plate 16 or the printing-applied surface 18; and the outer layer 2, 202 disposed, on the side on which the printing surface 13 is disposed, in contact with the inner layer 1, 201. The outer layer 2, 202 has a lower Asker C hardness than the inner layer 1, 201.

In this configuration, the deformation of the inner layer 1, 201 is small, and a force can be applied to the outer layer 2, 202 evenly over the entire printing-applied surface 18. This allows the force to be applied evenly over the entire outer layer 2, 202. Therefore, even when portions, such as the protrusions 19, on which the force pressing the printing-applied surface 18 is likely to be concentrated are present, the force is dispersed, so that the outer layer 2, 202 can easily follow the printing-applied surface 18. In this case, even when the protrusions 19 are disposed on the printing-applied surface 18, the printing surface 13 can come into contact with the entire printing-applied surface 18. Specifically, even when the printing-applied surface 18 has a complicated shape, the printing surface 13 can easily follow this shape, and printing can be performed such that even portions against which the printing surface 13 is not easily pressed, such as the side surfaces 18*e* and edges 18*c* of the protrusions 19, can be coated with the ink 17 with no uncoated areas. Since printing can be performed over the entire printing-applied surface 18 by pressing the printing blanket 10, 210, 210*a*, 210*b* against the printing-applied surface 18 only once, no seams are present in the printed region, and the number of printing steps can be reduced.

(2) In the printing blanket 210, 210*a*, 210*b* in Embodiment 2, the inner layer 201 has, on its side in contact with the outer layer 202*b*, the mold surface 205 having a shape resembling a shape obtained by transferring a shape of the printing-applied surface 18.

In this configuration, the force pressing the printing-applied surface 18 when the printing blanket 210 is pressed against the printing-applied surface 18 can be applied evenly over the entire printing-applied surface 18. In this case, the force is also applied evenly to the outer layer 2, and the outer layer 2 deforms substantially uniformly. Therefore, for example, even when the protrusions 19 are larger or the printing-applied surface 18 has a complicated shape, the effects described above in (1) can also be obtained.

(3) In the printing blanket 210, 210*a*, 210*b* in Embodiment 2, the mold surface 205 includes the outer circumferential mold surface 207 located on the side toward the outer circumference of the mold surface 205. The outer circumferential mold surface 207 is formed such that, when the printing surface 13 is pressed against the printing-applied surface 18, the distance between the outer circumferential mold surface 207 and the printing-applied surface 18 decreases as the distance to the outer circumference decreases.

In this configuration, when the printing surface 13 is pressed against the printing-applied surface 18, the deformation of the inner layer 201 with expansion toward the outer circumference can be suppressed. In this case, the force applied from the printing blanket 210 to the printing-applied surface 18 is not dispersed and is applied evenly over the entire printing-applied surface 18. Therefore, the effects described above in (1) can be obtained even though the printing-applied surface 18 has a more complicated shape than that in the configuration in (2).

(4) In the printing blanket 10, 210, 210*a*, 210*b* in Embodiment 1 or 2, the outer layer 2 is formed of a material having an Asker C hardness within a range of from 50% to 70% inclusive of the value of the Asker C hardness of the inner layer 1, 201.

In this configuration, the difference between the ease of deformation of the outer layer 2 and the ease of deformation of the inner layer 1, 201 becomes distinct, and the effects described above in (1) to (3) can be obtained more reliably.

(5) In the printing blanket 10, 210, 210*a*, 210*b* in Embodiment 1 or 2, the outer layer 2 has a thickness equal to or larger than twice the height of the protrusions 19 formed on the printing-applied surface 18.

In this configuration, even when the height of the protrusions 19 formed on the printing-applied surface 18 is changed, the effects described above in (1) to (4) can be obtained by changing the thickness of the outer layer 2.

(6) The printing blanket 10, 210, 210*a* in Embodiment 1 or 2 further includes the protective coating layer 3 disposed on the side of the outer layer 2 toward the printing surface 13.

In this configuration, the protective coating layer 3 allows the durability of the printing surface 13 of the printing blanket 10, 210, 210*a* to be maintained and also allows the exudation of, for example, silicone oil from the outer layer 2 to be suppressed.

(7) In the printing blanket 10, 210, 210*a* in Embodiment 1 or 2, the protective coating layer 3 has a thickness of from 0.1 mm to 1 mm inclusive.

In this configuration, the protective coating layer 3 allows the durability of the printing surface 13 to be maintained and also allows the exudation of, for example, silicone oil from the outer layer 2 to be suppressed. In this case, even when the protective coating layer 3 is formed of a high-hardness material to maintain the durability of the printing surface 13, the deformation of the outer layer 2 is not impeded, and the effects described above in (1) to (6) can be obtained.

(8) In the printing blanket 10, 210, 210*a* in Embodiment 1 or 2, the outer layer 2 may be formed of a plurality of plies of a sheet-shaped material.

In this configuration, the thickness of the outer layer 2 can be adjusted by stacking plies of the predetermined sheet-shaped material. Therefore, even when the height of the protrusions 19 formed on the printing-applied surface 18 is changed, it is unnecessary to prepare sheet materials having different thicknesses. This allows the outer layer 2 to be configured at low cost.

(9) In the printing blanket 10, 210 in Embodiment 1 or 2, the outer layer 2 includes silicone rubber containing silicone oil.

In this configuration, the printing blanket 10, 210 can easily deform and can easily follow the shape of the printing-applied surface 18, and the effects described above in (1) to (5) can be obtained more reliably.

REFERENCE SIGNS LIST

1 inner layer, 2 outer layer, 3 protective coating layer, 4 bottom surface, 10 printing blanket, 11 apex, 12 interface, 13 printing surface, 16 printing plate, 17 ink, 18 printing-applied surface, 18*a* upper surface, 18*b* corner, 18*c* edge, 18*d* flat portion, 18*e* side surface, 19 protrusion, 20 printing object, 30 arrow, 31 arrow, 32 arrow, 33 arrow, 34 arrow, 35 arrow, 36 arrow, 37 arrow, 101 inner layer, 110 printing blanket, 201 inner layer, 202*a* outer layer, 202*b* outer layer, 205 mold surface, 206 recessed portion, 207 outer circumferential mold surface, 208 inner mold surface, 210 printing blanket, 210*a* printing blanket, 210*b* printing blanket, 230 arrow, h1 distance, h2 distance, h3 distance, h4 distance

The invention claimed is:

1. A printing blanket comprising:

a printing surface configured for pressing against a printing plate on which an ink is placed and against a printing-applied surface that is a target of printing, wherein the printing surface is deformed from an un-deformed configuration to a deformed configuration when the printing surface is pressed against the printing-applied surface;

an inner layer to which a pressing force is applied when the printing surface is pressed against the printing plate or the printing-applied surface; and an outer layer disposed, on a side on which the printing surface is disposed, in contact with the inner layer, the outer layer having a lower Asker C hardness than the inner layer, wherein, with the printing surface in the un-deformed configuration, the inner layer has, on a side thereof in contact with the outer layer, a mold surface in contact with the outer layer having a concavity to facilitate printing on a protrusion that protrudes from a flat portion of the printing-applied surface, the printing blanket being configured and arranged such that, with the printing surface pressed against the printing applied surface in the deformed configuration, a distance from an upper surface of the protrusion to an upper surface of the cavity in the mold surface directly above the upper surface of the protrusion is substantially the same as a distance from the flat portion of the printing-applied surface to a flat portion of the mold surface directly above the flat portion of the printing-applied surface whereas, with the printing surface in the undeformed configuration and not pressed against the printing applied surface, a distance from the printing surface to the upper surface of the concavity in the mold surface is greater than a distance from the printing surface to the flat portion of the mold surface.

2. The printing blanket of claim 1, wherein the mold surface includes an outer circumferential mold surface located on an outer circumference side of the mold surface, and the outer circumferential mold surface is formed such that, when the printing surface is in the un-deformed configuration and is then pressed against the printing-applied surface, a distance between the outer circumferential mold surface and the printing-applied surface decreases as a distance to outside of the outer circumferential mold surface decreases.

3. The printing blanket of claim 1, wherein the outer layer is formed of a material having an Asker C hardness within a range of from 50% to 70% inclusive of a value of an Asker C hardness of the inner layer.

4. The printing blanket of claim 1, wherein the outer layer has a thickness equal to or larger than twice a height of the protrusion formed on the printing-applied surface.

5. The printing blanket of claim 1, further comprising a protective coating layer disposed on a printing surface side of the outer layer.

6. The printing blanket of claim 5, wherein the protective coating layer has a thickness of from 0.1 mm to 1 mm inclusive.

7. The printing blanket of claim 6, wherein the protective coating layer has a higher hardness than the outer layer.

8. The printing blanket of claim 1, wherein the outer layer is formed of a plurality of plies of a material.

9. The printing blanket of claim 1, wherein the outer layer comprises silicone rubber containing silicone oil.

* * * * *